US005195297A

United States Patent [19]

Lancaster et al.

[11] Patent Number: 5,195,297

[45] Date of Patent: * Mar. 23, 1993

[54] UNITIZED DISPLAY PACKAGES AND METHOD AND APPARATUS FOR UTILIZING DISPLAY PACKAGES

[75] Inventors: William G. Lancaster; Joseph Lancaster, both of Louisville, Ky.

[73] Assignee: Lantech, Inc., Louisville, Ky.

[ * ] Notice: The portion of the term of this patent subsequent to Jul. 5, 2005 has been disclaimed.

[21] Appl. No.: 694,075

[22] Filed: May 1, 1991

Related U.S. Application Data

[63] Continuation-in-part of Ser. No. 347,063, May 4, 1989, which is a continuation of Ser. No. 186,348, Apr. 26, 1988, Pat. No. 4,845,920, which is a continuation of Ser. No. 871,149, Jun. 3, 1986, Pat. No. 4,754,594, which is a continuation of Ser. No. 125,275, Feb. 27, 1980, abandoned.

[51] Int. Cl.[5] ..... B65B 11/04

[52] U.S. Cl. ..... 53/399; 53/411; 53/587; 53/556; 53/176

[58] Field of Search ..... 53/399, 441, 449, 556, 53/587, 588, 389.2, 176

[56] References Cited

U.S. PATENT DOCUMENTS

| | | | |
|---|---|---|---|
| 4,079,566 | 3/1978 | Stoecklin | 53/399 |
| 4,235,062 | 11/1980 | Lancaster | 53/399 |
| 4,754,594 | 7/1988 | Lancaster | 53/399 |
| 4,807,427 | 2/1989 | Casteel | 53/441 X |
| 4,845,920 | 7/1989 | Lancaster | 53/441 X |

FOREIGN PATENT DOCUMENTS

| | | | |
|---|---|---|---|
| 177413 | 4/1986 | European Pat. Off. | 53/588 |
| 2522113 | 11/1976 | Fed. Rep. of Germany | 206/597 |
| 2256871 | 8/1975 | France | 53/588 |

*Primary Examiner*—John Sipos
*Attorney, Agent, or Firm*—Finnegan, Henderson, Farabow, Garrett & Dunner

[57] ABSTRACT

A load of successive units stacked in a longitudinal direction has aides with junctions extending in a lateral direction between successive units. Each of the units has at least one relatively high strength area which is resistant to circumferential crushing in the lateral direction and at least one low strength area which is substantially less resistant to circumferential crushing in the lateral direction than the high strength area. A film web is dispensed from a film web dispenser and stretched along the direction in which it is dispensed. The film web collapsed into a roped configuration and successively aligned with and within selected high strength areas by moving the film web dispenser generally in the lingitudinal direction relative to the load and stopping the relatively longitudinal movement of the web dispenser and the load at times when the web is in alignment with one of the selected high strength areas. The roped web is wrapped around the load at each of the selected high strength areas in alignment with each of the selected high strength areas. The web is then expanded from the roped configuration and wrapped around the load to cover the sides of the load in both the high and low strength areas.

17 Claims, 5 Drawing Sheets

UNITIZED DISPLAY PACKAGES AND METHOD AND APPARATUS FOR UTILIZING DISPLAY PACKAGES

RELATED APPLICATIONS

This is a continuation-in-part of U.S. Pat. No. 07/347,063 filed on May 4, 1989, which is incorporate reference and is a continuation of U.S. patent application No. 186,348 filed Apr. 26, 1988 now U.S. Pat. No. 4,845,920, which is a continuation of U.S. patent application No. 871,149 filed Jun. 3, 1986 now U.S. Pat. No. 4,754,594, which is a continuation of U.S. patent application No. 125,275 filed Feb. 27, 1980 now abandoned.

BACKGROUND OF THE INVENTION

The present invention relates to a unitized load and a method and apparatus for unitizing a load. More particularly, it relates to a unitized display package and a method and apparatus for unitizing a display package by stretch wrapping.

In a display package, products are arranged in stacked layers, unitized, shipped to the point of sale, and displayed at the point of sale without needing to be removed from the arrangement in which they are shipped. Since display packages are often used with products which do not have inherent strength, stiffening supports, such as cardboard trays and platforms, are used between each layer to contribute to stacking strength. Because the products do not have inherent strength, but need to be visible to the consumer at the point of sale, the cardboard support and trays only extend a small proportion of the height of the products.

Prior attempts to unitize display packages with stretch wrapping techniques prior to shipping have been met with several drawbacks. When stretch wrapping a display package with a web of stretch film, the stretch film can only be wrapped at low tension. Otherwise, the products will be distorted, crushed or otherwise damaged during the wrapping process. However, when the web is wrapped at low tension, it can not adequately unitize the stacked products and prevent them from coming apart and spilling when being transported to the point of sale.

SUMMARY OF THE INVENTION

Accordingly, it is an object of the present invention to provide a method and apparatus for stretch wrapping a display package which does not require a substantial amount of packaging material to protect the product when wrapping and transporting the product.

It is also an object of the present invention to provide a method and apparatus for wrapping a display package which advantageously utilizes the benefits of stretch wrapping including protection from moisture and dust, simplicity and economy in operation, and minimal modification of conventional stretch wrapping methods and apparatus.

It is a further object of the present invention to provide a method and apparatus for wrapping a display package which produces a resulting display package which stays unitized during transport, and does not require individual product removal during setup.

Additional objects and advantage of the invention will be set forth in the description which follows, and in part will be obvious from the description, or may be learned by practice of the invention. The objects and advantages of the invention may be realized and obtained by means of instrumentalities and combinations particularly pointed out in the appended claims.

To achieve the foregoing objects, and in accordance with the purposes of the invention as embodied and broadly described herein a method is provided for unitizing a load of successive units stacked in a longitudinal direction. The load has sides with circumferential junctions extending in a lateral direction between successive units. Each of the units has at least one relatively high strength area which is resistant to circumferential crushing in the lateral direction and at least one relatively low strength area which is substantially less resistant to circumferential crushing in the lateral direction than the high strength area.

A web is dispensed from a web dispenser and the web is stretched along the direction in which it is dispensed. The web is collapsed into a roped configuration and successively aligned with and within selected high strength area by moving the web dispenser generally in the longitudinal direction relative to the load and stopping the relative longitudinal movement of the web dispenser and the load at times when the web is in alignment with each of the selected high strength areas.

The roped web is successively wrapped around the load at each of the selected high strength areas in alignment with and within each of the selected high strength areas. The web is expanded from the roped configuration and wrapped around the load to cover the sides of the loads in both the high and low strength areas.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below serve to explain the principles of the invention.

FIGS. 8*a* through 13*a* are perspective views of products which are part of the display packages shown in FIGS. 8–13.

DESCRIPTION OF THE PREFERRED EMBODIMENT

Reference will now be made in detail to the present preferred embodiments of the invention as illustrated in the accompanying drawings.

In accordance with the present invention there is provided an apparatus for unitizing a load of successive units stacked in a longitudinal direction. In one aspect of the present invention, each of the successive units is a layer of subunits.

Figure 7:
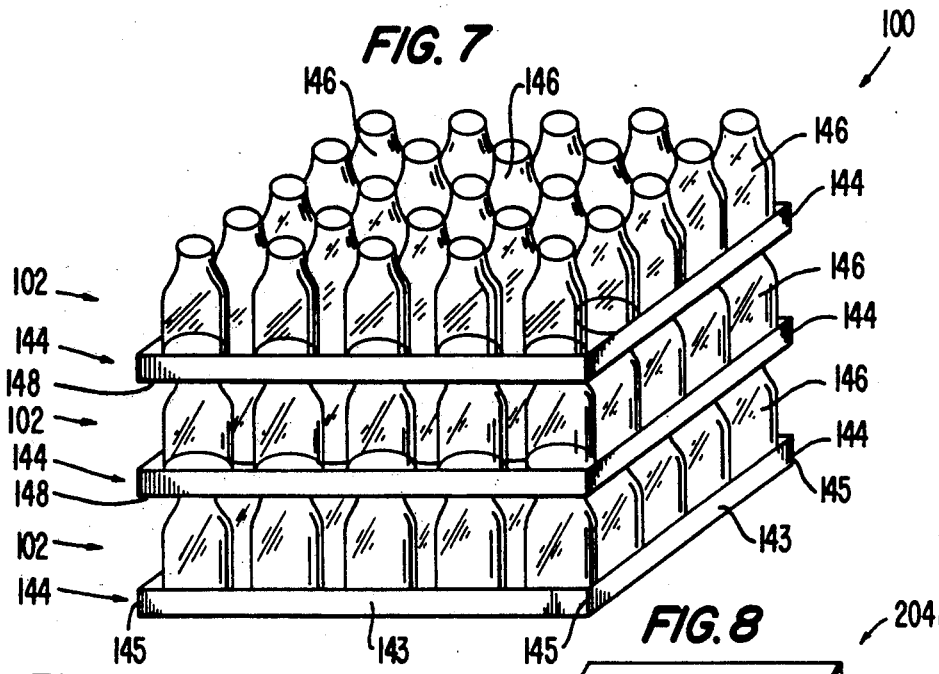
FIG. 7 is a perspective view of a display package.

As shown in FIG. 7, the load 100 includes three successive units 102. Each unit 102 includes a cardboard tray 144 having sidewalls and a layer of subunits of individual products, which in the illustration are filled plastic soft drink bottles 146. The successive units 102 are stacked in a longitudinal direction, which in FIG. 7 is the vertical direction.

The load 100 has four vertical faces which define sides 143, and longitudinally extending corners 145. Circumferential junctions 148 extend between successive units 102 in a lateral direction, which in FIG. 7 is the horizontal direction. Junctions 148 constitute horizontal planes between the bottom of trays 144 and the tops of the bottles 146.

Each of the units 102 have at least one relatively high strength area which is resistant to circumferential crushing in the lateral direction and at least one low strength area which is substantially less resistant to circumferential crushing in the lateral direction than the high strength area. As shown in FIG. 7, the relatively high strength areas are the sides of trays 144. For units 102, the sidewalls of trays 144 have relatively high strength, low compressibility and resistance to crushing in the horizontal direction 140 in comparison to the remaining portions of the units 102 which are to be protected from crushing by the high strength areas. The remaining portions consist of unprotected sides of plastic soft drink bottles 146 which are easily deformed and crushed by forces exerted against them in the horizontal direction.

According to the present invention, means are provided for dispensing a web from a web dispenser and stretching the web along the direction in which it is dispensed. As shown in FIGS. and 2, the means for dispensing and stretching the web includes a carriage 20 for supporting a film roll 24, and a magnetic brake 26 and roller assembly 29 mounted on carriage 20. Carriage 20 is moveably mounted on a frame 12, which is attached to a base 13.

The film roll 24 is mounted on a mandrel 21 of carriage 20, and the dispensing of the film web is restricted by the action of magnetic brake 26. Brake 26 applies a restrictive force on the film roll, subjecting the film material to a braking force causing it to stretch as it is wrapped around the load. The restrictive force is preferably applied by utilizing a roller assembly 29 to engage the outside of the film roll and supply a constant force on the film roll uniformly stretching the film web as it leaves the roll.

The means for dispensing and stretching the web may, in certain applications, include a prestretch mechanism, such as the one shown in more detail in U.S. Pat. No. 4,302,920, which is incorporated by reference. As known by those skilled in the art, prestretch mechanisms are used to stretch the film web to high elongation rates before being wrapped on the load.

Figure 3:
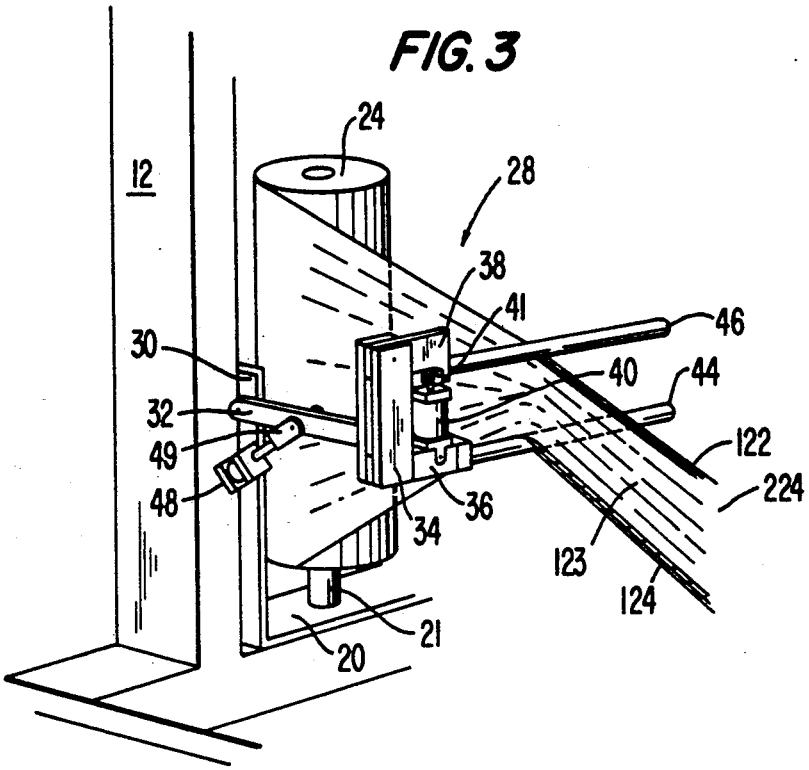
FIG. 3 is an enlarged perspective view of the web collapsing mechanism shown in FIG. 2.
Figure 5:
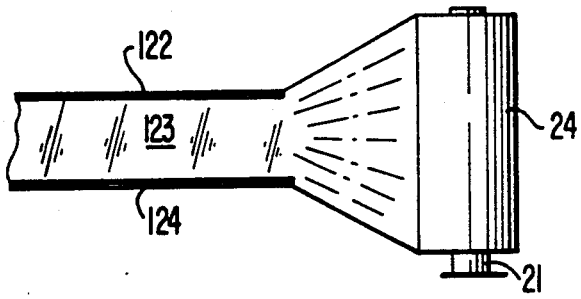
FIG. 5 is a side elevational view of the film roped at each edge for wrapping around the load.

According to the present invention, means are provided for collapsing the web into a roped configuration and expanding the web from the roped configuration. As shown in FIG. 3, the film collapsing means includes a film collapsing mechanism 28. Film collapsing mechanism 28 includes a support plate 30 secured to roll carriage 20 and a rotatable support bar 32 having one end rotatably mounted to support plate 30 and the other end being secured to a support block 34. The support block 34 has a stationary leg 36 secured to it and rotatable leg 38 rotatably mounted to the block above the stationary leg. A fluid activated cylinder 40 is mounted to the stationary leg 36 with a yoke and 41 of its piston rod being connected by a pin to the rotatable leg 38. A linear rod 44 is secured to the stationary leg 36 and a similarly shaped movable rod 46 is secured to the movable rotatable leg 38.

A fluid activated cylinder 48 is secured to support plate 30 A yoke end 49 on a piston rod connected to rotatable support bar 32. Cylinder 48 can be energized automatically at desired times by known fluid circuitry to move block 34 and its associated rods 44 and 46 up and down in a plurality of positions to engage the film web. The cylinder 40 is energized to move the rotatable leg 38 and its associated rod 46 in an arc of approximately 90 degrees out of the path of the film when it is desired to expand the web from the roped configuration. Film collapsing mechanism 28 is used to collapse the film web so that the web is formed into a roped configuration, which in certain operations preferably includes two roped edges of 122 and 124 of concentrated web material and a central unroped portion 123 of web material connecting roped edges 122 and 124 in the form of an unroped membrane. The ropes 122 and 124, since they are concentrated bands of film, grab onto and dig into the outside surface of the load.

In another embodiment, the film collapsing mechanism is in the form of a rotatable sectioned funnel constructed to engage the film web edges with the width of the film gradually being diminished to bunch the film edges as it is transported through the funnel mechanism. The film collapsing mechanism is moved into and out of the film path so that the web is collapsed into a roped configuration when the film collapsing mechanism is in the film path and the web is expanded from the roped configuration to its original width when film collapsing mechanism is removed from the film path.

According to the present invention, means are provided for successively aligning the roped web with and within the selected high strength areas on the load by moving the web dispenser generally in the longitudinal direction relative to the load and stopping the relative longitudinal movement of the web dispenser and the load at times when the web is in alignment with one of the selected high strength areas.

Figure 4:
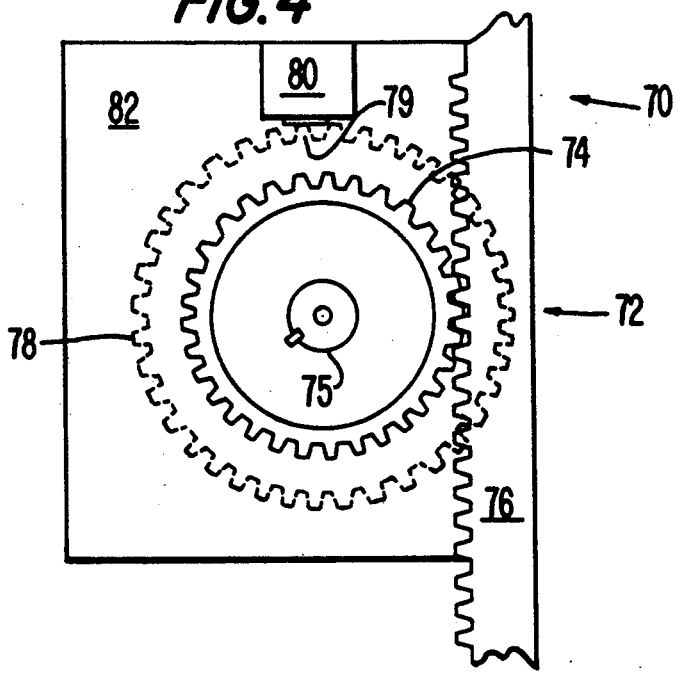
FIG. 4 is a side elevational view partially in phantom of a drive mechanism and sensing device used in the apparatus shown in FIG. 2.

As shown in FIG. 4, the aligning means includes a numerical control mechanism 70 and a vertical drive mechanism 72. Vertical drive mechanism 72 raises and lowers the roll carriage 20 on frame 12 through the use of a positive gear 74 rotatably mounted on roll carriage 20. Gear 74 engages a rack 76 which is attached to frame 12. A drive motor (not shown) connected to gear 74 rotates gear 74 against stationary rack 76 causing gear 74 and roll carriage 20 on which it is mounted to move in the vertical direction.

Numerical control mechanism 70 may be implemented by a variety of devices. As shown in FIG. 4, numerical control mechanism 70 includes a sprocket 78 shown in phantom line which is mounted to pinion gear shaft 75 and rotates with pinion gear 74. Sprocket 78 rotates past a sensor device 80 mounted on gear housing 82. Sensor device 80 can be a standard metal detection device which senses teeth 79 of sprocket 78 as those teeth 79 pass by sensor device 80. The teeth 79 which pass by sensor device 80 are counted by using standard counting circuitry to determine the position of the roll carriage 12 on the frame 18. Alternatives to magnetic sensor 80 which sense the ferrous content of the sprocket teeth and send pulses which are converted to electrical signals, include optical scanning devices such as photo cells.

Numerical control system 70 is programmed to drive pinion gear 74 until it reaches a plane of low compressibility, at which point it stops driving pinion 74.

Figure 1:
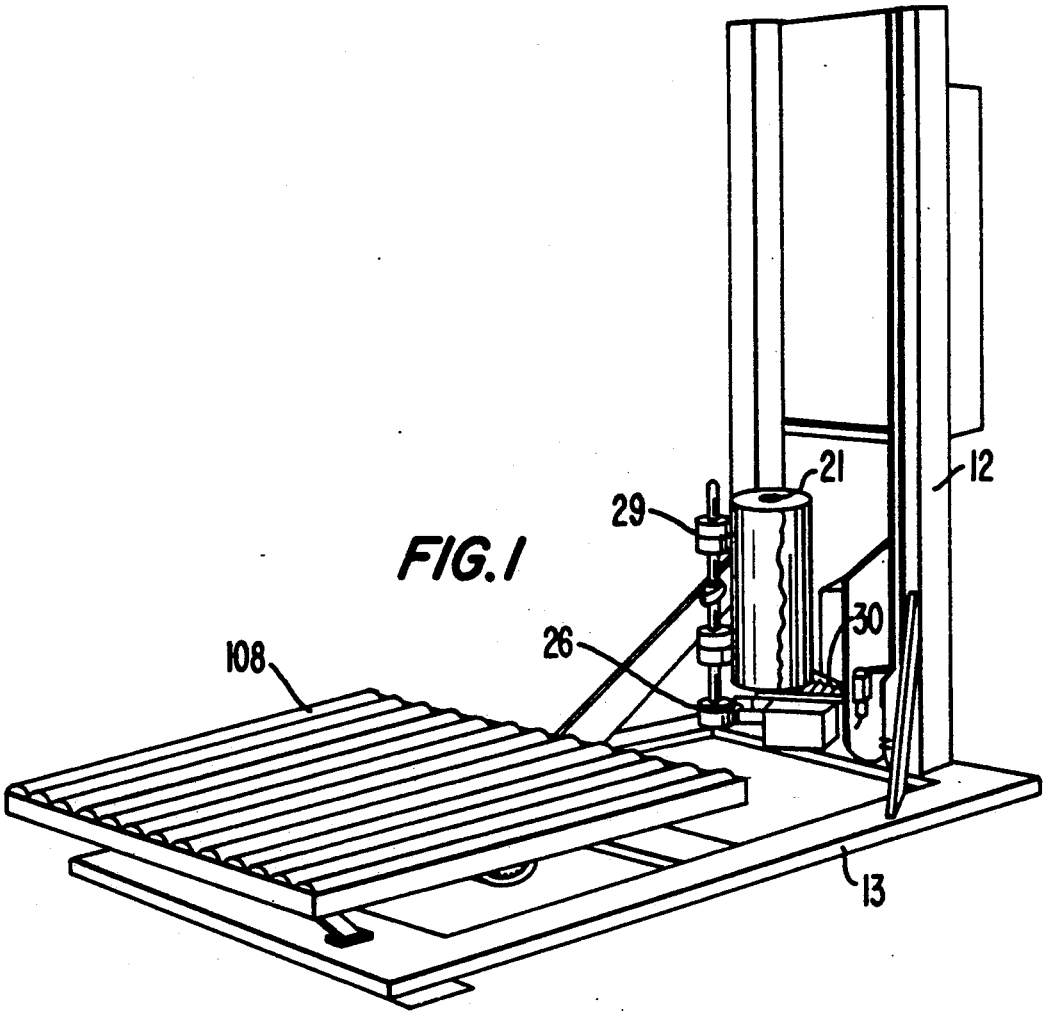
FIGS. 1 and 2 are perspective views of an apparatus for unitizing display packages according to the present invention.
Figure 2:
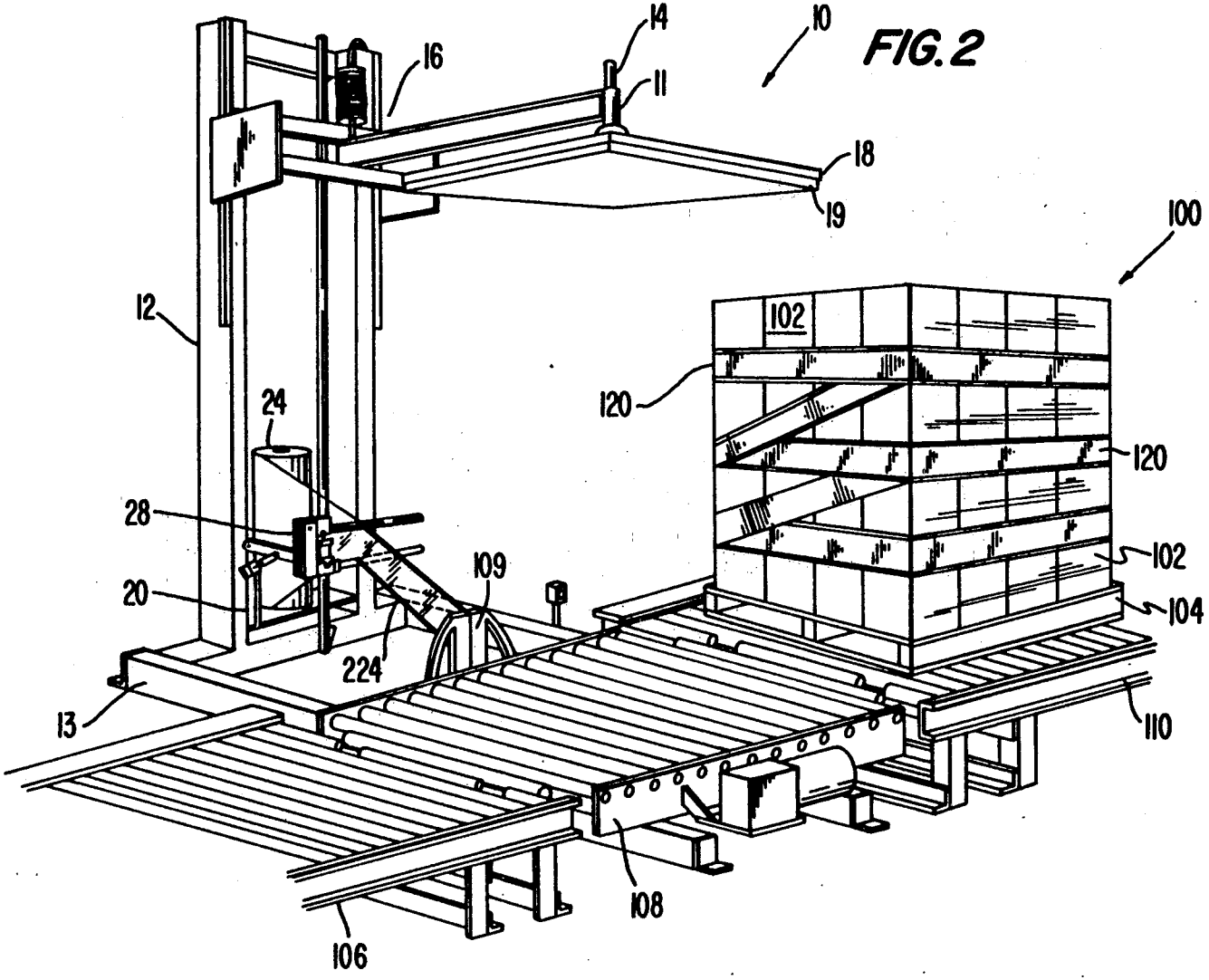

According to the present invention, means are provided for successively wrapping the roped web around the load at each of these selected areas of high strength in alignment with and within each of the high strength areas and for wrapping the expanded web around the load to cover the sides of the load in both the high and low strength areas. As shown in FIGS. 1 and 2, such means includes a turntable 108 which is driven by a motor and gear reducer to rotate about a central vertical axis. As shown in FIG. 2, turntable 108 includes the middle segment of a powered roller conveyor which is positioned between an infeed roller conveyor 106 and an outfeed roller conveyor 110. The film collapsing mechanism, the aligning mechanism and, the wrapping mechanism work together so that the roped web is within the high strength areas and so that the roped web does not exert any significant force on the low strength areas. As an alternative to the turntable, the means for wrapping includes a mechanism for driving the roll carriage in a circle around a stationary load.

Frame 12 which supports roll carriage 20 also includes a platen assembly having a platen 18 with a flexible lower surface 19 which may be placed on top of the load during wrapping to hold the load in place. Platen 18 is mounted on a central axle 14 which is aligned with the axis of rotation of turntable 108. Axle 14 is mounted in a journal 11 in the end of support ar connected to support structure 16. Support structure 16 is vertically positioned on frame 18 with a rack and pinion drive arrangement so that platen 18 may be lowered on top of the load during wrapping, and raised from the top of the load after wrapping to allow the wrapped load to be removed and a new load to be placed in position for wrapping.

To operate the apparatus, the film web is clamped in a conventional stretch wrapping clamp 109 which is positioned on one side of turntable 108. The web is in a roped configuration because it is being collapsed by film collapsing mechanism 28.

Load 100 is transported from infeed roller conveyor 106 onto turntable 108. Platen 18 is lowered on top of load 100 to hold load 100 in place while allowing it to rotate about a central vertical axis.

Turntable 108 is driven to rotate load 100 about a central vertical axis and the film web is stretched, collapsed by film collapsing mechanism 28 and wrapped about the first plane of relatively low compressibility, namely the wooden pallet 104 on which load 100 is supported. The collapsed film web has a sufficiently narrow width so that it is only wrapped on pallet 104 and not on an adjacent lower strength area of load 100 which is less resistant to crushing than pallet 104.

After pallet 104 is wrapped around its full circumference with roped film web, numerical control 70 commands the vertical drive 72 of roll carriage 20 to move roll carriage 20 vertically upward and stop roll carriage 20 when roll carriage 20 is in alignment with the next high strength area. In being so aligned, the collapsed film web has a sufficiently narrow width so it is only wrapped on the high strength areas and not on adjacent low strength areas so that no significant force is exerted on the low strength areas. As can be seen during operation of the machine, it may be preferable to move roll carriage 20 slightly past the point of alignment and then back to the point of alignment to align the web with the high strength area which is resistant to crushing.

Vertical drive 72 starts moving roll carriage 20 as soon as the roped film web engages and passes a corner of the load 100 and moves roll carriage 20 to align the web with the next high strength area before the next corner of load 100 engages the roped web. In so doing, the roped web engages corners of load 100 only at the high strength areas and does not engage and crush corners of the load 100 at the low strength areas.

When the roped web is aligned with the next high strength area, and vertical drive 72 has stopped moving roll carriage 20 relative to load 100, the roped film web wraps around the circumference of load 100 at that next high strength area. The procedure for moving the roll carriage 2 with the roped film web to the next high strength area is performed in the same manner repeatedly until all the high strength areas are wrapped with the roped film web, and the roll carriage and roped web of film is near the top of the load.

At this point, the film collapsing mechanism 28 is moved from the path of the film web so that the web is expanded from the roped configuration to its original width and the expanded web is stretched and wrapped around the load to cover the sides of the load in both the high and low strength areas by spirally wrapping the film web in overlapped fashion around the load, rotating turntable 108 while moving roll carriage 20 vertically downward with vertical drive 72. Turntable 108 is then stopped, film collapsing mechanism 28 is again placed in the film web path to collapse the film, and the collapsed film web is clamped in clamp 109, cut, and wiped down against the load. The cut and wipe down can be performed by hand or an automated cut and wipe down device shown in U.S. Pat. Nos. 4,735,033 and 4,779,396, which are incorporated by reference.

After wrapping is completed, platen 18 is raised and wrapped load 100 is transported off turntable 108 onto outfeed conveyor 110 and a new load is transported onto turntable 108 by infeed web issue from the same film roll and from a continuous wrapping process which requires only one roll of film and no interruption in the wrapping process. While it is presently preferable to wrap the load with the roped web before wrapping the load with the expanded web, it is also within the scope of the invention to wrap the load with the expanded web before wrapping the load with the roped web.

As shown in FIG. 2, the present invention provides a unitized load having successive units stacked in a longitudinal direction. The load has sides with circumferential junctions extending in the lateral direction between successive units. Each of the units have at least one high strength area which is resistant to circumferential crushing in the lateral direction and at least one relatively low strength area which is substantially less resistant to crushing in the lateral direction than the high strength areas. The unitized load also includes a tensioned web wrapped in a roped configuration around the load at the high strength areas, and in an expanded configuration around the load covering the load in both the high and low strength areas.

The present invention may be employed with a variety of products. Several examples are illustrated using similar numerals for similar elements.

Figure 8B:
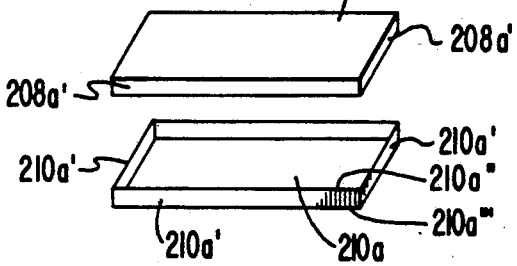
Figure 8:
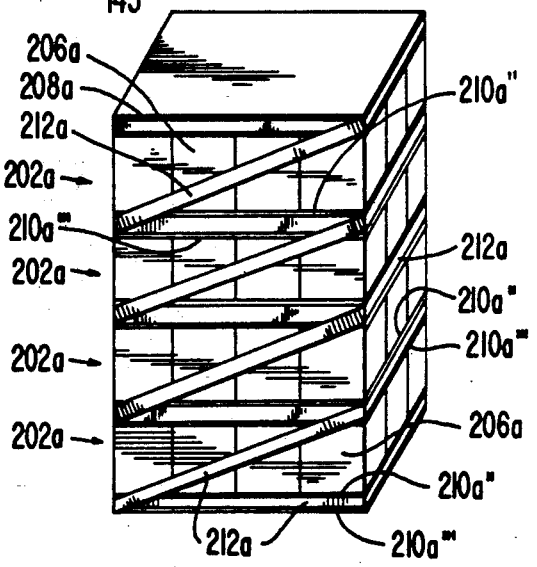
FIGS. 8 through 13 are perspective views of various display packages wrapped in accordance with the present invention.
Figure 8A:
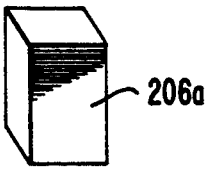

As shown in FIG. 8, each of the successive units 202*a* in the load 204*a* include two-dimension array of crushable products 206*a* (detailed in FIG. 8*a*) which are supported by a cardboard tray 210*a* from below. A cardboard tray 208*a* covers the top of the load. The trays are detailed in FIG. 8*b*. The respective sidewalls 208*a*, and 210*a*, of cardboard trays 208*a* and 210*a* are the high strength areas and the portion of the products extending above the sidewalls 210*a*, of trays 210*a* is the low strength area. The successive units 202*a* of the load are unitized by wrapping a roped web 212*a* around the circumference of each of the bottom trays 210*a* in succession starting from the bottom of the load of successive units and moving to the top of the load of successive units, and then spirally wrapping an expanded web around the load of successive units to cover both the high and low strength areas of the sides of the load by moving from the top to the bottom of the load of successive units. The roped web is within the high strength area, namely between the upper edges 210*a*'' and lower edges 210*a*''' of sidewalls 210*a*' of cardboard trays 210*a*.

Figure 9:
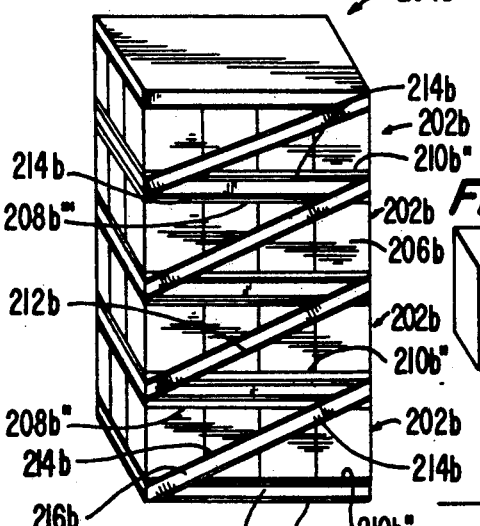
Figure 9A:
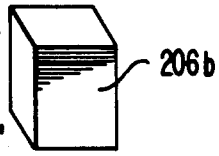
Figure 9B:
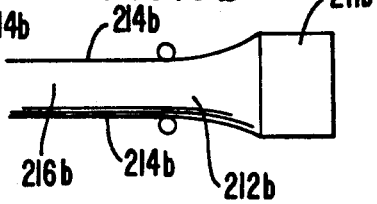

As shown in FIG. 9, each of the successive units 202*b* in the load 204*b* includes a two-dimensional array of crushable products 206*b* (detailed in FIG. 9*a*) supported from below by a cardboard tray 210*b* and supported above by a cardboard tray 208*b*. The sidewalls 208*b*' and 210*b*' of cardboard trays 208*b* and 210*b* are the high strength area and the products 206*b* are the low strength areas. Sidewalls 208*b*' and 210*b*' have upper edges 208*b*'' and 210*b*'' , and lower edges 208*b*''' and 210'''. The successive units 202*b* of the load are unitized by forming a film web from a film roll 211*b* into a configuration (detailed in FIG. 9*b*) having roped edges 214*b* of concentrated web material and a central unroped portion 216*b* of web material connecting the roped edges 214*b*. This roped web 212*b* is wrapped around the load at the junctions between the top tray 208*b* of one unit and the bottom tray 210*b* of another unit, covering the junction with the unroped central portion 216*b* of the web and grabbing the sidewalls 208*b*' and 210*b*' of trays 208*b* and 210*b* of the successive units with the roped edges to hold the units together. The roped web 212*b* is wrapped around the load in such a fashion at each of the junctions, moving from the bottom to the top of the load, and then wrapping an expanded web of film spirally from the top to the bottom of the load, covering both the high and low strength areas of the load.

Figure 10:
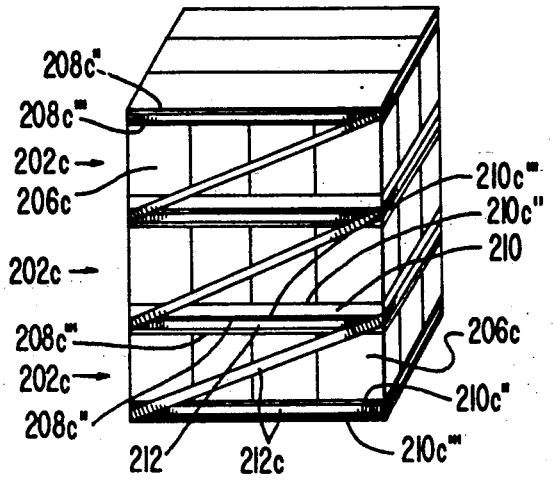
Figure 10A:
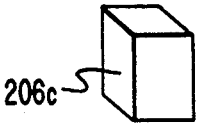

As shown in FIG. 10, each unit 202*c* in the load 204*c* includes a two-dimensional array of crushable products 206*c* (detailed in FIG. 10*a*) with a high strength top tray 208*c* and a bottom tray 210*c* similar to that in FIG. 9. However, the load is unitized by wrapping a roped web 212*c* around each of the top trays 208*c* in sequence from the bottom to the top of the load, and then wrapping the load with a full web of film from the top to the bottom of the load covering both the high and low strength areas of the load.

Figure 11:
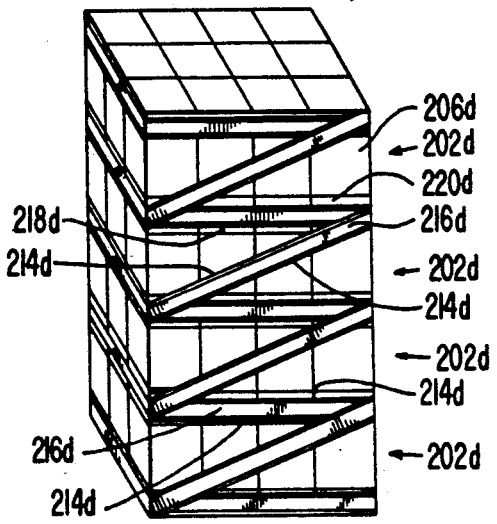
Figure 11A:
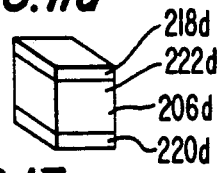

In FIG. 11, each unit 202*d* of the load 204*d* includes a two-dimensional array of products 206*d* (detailed in FIG. 11*a*) having upper and lower areas 220*d* which are high strength areas and a middle area 222*d* which is a low strength area. In this arrangement, the load is unitized by wrapping a roped web 212*d* (similar to roped web 212*b* of FIG. 9*b*) having roped edges of concentrated web material and a central unroped portion of web material connecting the roped edges, covering the junctions between the upper high strength area 218*d* with the adjoining lower high strength area 220*d*, covering the junctions with the unroped central portion of the web and grabbing the successive units with the roped edges to hold the units together. The upper, middle and lower areas of the load are then covered with a spirally wrapped expanded web of film.

Figure 12:
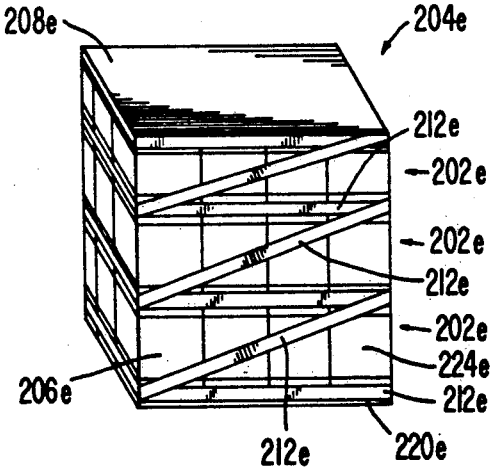
Figure 12A:
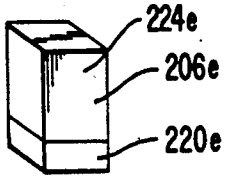

In FIG. 12, each unit 202*e* of the load 204*e* includes a two-dimensional array of products 206*e* (detailed in FIG. 12*a*) having a lower area 220*e* which is a high strength area, and upper and middle areas 224*e* which are low strength areas. The lower area 220*e* is wrapped with a roped web 212*e* at each layer and then the sides of the load are covered with an expanded web of film.

Figure 13:
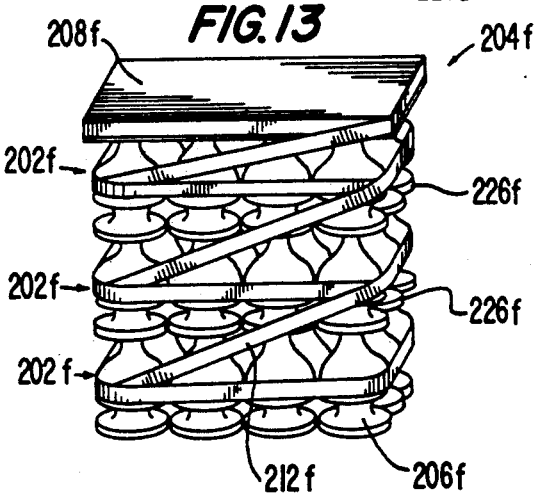
Figure 13A:
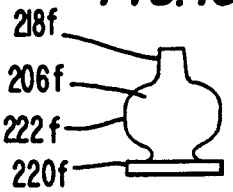

In FIG. 13, each unit 202*f* of the load 204*f* includes a two-dimensional array of products 206*f* (detailed in FIG. 13*a*) having a middle high strength area 222*f* which is resistant to circumferential crushing due to the inherent shape and strength of the products. The upper area 218*f* and lower area 220*f* are low strength areas which are resistant to circumferential crushing because a band placed around the circumference of the product 206*f* at the upper area 218*f* or the lower area 220*f* would cause the product 206*f* to be displaced inwardly due to the shape of the products 206*f*. Each two-dimensional array of products is separated by a sheet of cardboard 226*f*. The load is unitized by wrapping a roped web 212*f* around each unit at the middle 232*f* of the units and then wrapping an expanded web of film around the load to cover the upper, middle and lower areas of the units forming the load.

When the load is wrapped with a web having roped edges of concentrated web material and a central unroped portion of web material connecting the roped edges, the operator has previously determined the height of the unit cartons, and has preset the drive of the carriage so that it will proceed up a distance sufficient to allow each roped edge to engage one of the adjacent units with a membrane between the roped edges of film web covering, the junction between the vertical units. Each time the sensor 80 and its associated sensor mechanism 70 determines that the pinion gear 74 has traveled up the rack a predetermined distance, the carriage drive stops and the rotating load causes one or more layers of roped web to be deposited along the junction of the next higher unit and the underlying unit.

Thus, the load is contained together with two ropes with a concentrated force. One rope is placed on one layer of units and the other rope is placed on the other layer of units with a unitary membrane connecting the two ropes. The ropes are used to unitize each layer of product while the layer of membrane of the film web secures each layer to the other layer preventing destruction of the load by horizontal shear forces and vertical forces caused by jolting, bouncing and settling. The concentration of the force of the film web on the load exactly where the forces are required eliminates the possibility of unequal forces that tend to destroy and not unitize the load. By wrapping all four sides of the load with equal forces the transfer of the film web from one layer to the other has no ill effects on the stability of the load. After sufficient film has been placed around the load, the cycle is finished and the film end is either secured mechanically or manually onto the unitized load by heat sealing, mechanical closure apparatus or simply through the use of a tacky film.

In an alternate mode of operation, the carriage can be programmed to stop at alternate carton junctions in one direction wrapping them in the manner and when returned in the opposite direction wrap those junctions which had been skipped in the first directional wrap.

It should be noted that the steps of the wrapping process in some instances can be interchangeable without departing from the scope of the invention and that such steps ca be interchanged and are equivalent.

Figure 6:
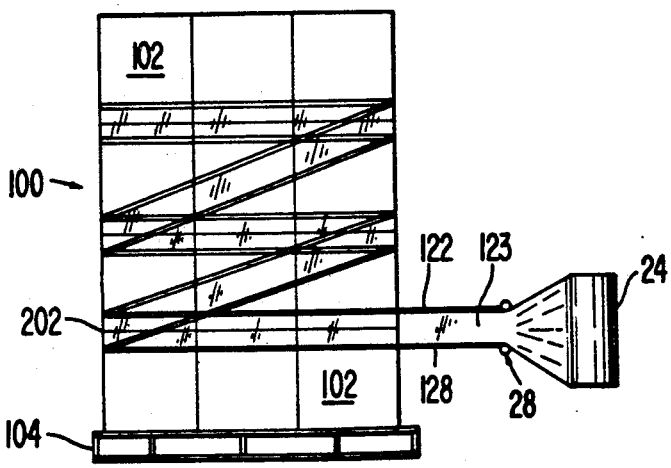
FIG. 6 is a side elevational view of a load wrapped in accordance with the present invention.

Since the wrap cycle starts at the bottom or at the top of the load, a prior determination is made regarding the distances to the junctions between the carton layer so that the distance is counted by sensor 80, one or more collapsed wraps may be wrapped around the junction between the units before a carriage is carried upward to the next junction between packages where it stops its vertical travel and wraps the junction and associated cartons. During the entire wrap the turntable is continuously rotated. It can be seen from FIG. 6 that the wrap forms a substantial Z-shaped configuration as it wraps horizontally between the junction of the units and traverses upwardly or downwardly as the load is rotated and the carriage travels between the junctions of the cartons.

As in all stretch wrapping processes, the film or web material used is selected in accordance with the load and wrapping operation. Many stretch wrap films and other web materials are well known and currently available.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the appended claims and their equivalents.

What is claimed is:

1. A method of unitizing a load of successive units stacked in a longitudinal direction, the load having sides with circumferential junctions extending in a lateral direction between successive units, each of the units having at least one relatively high strength area which is resistant to circumferential crushing in the lateral direction and at least one low strength area which is substantially less resistant to circumferential crushing in the lateral direction than the high strength area, comprising:

dispensing a web from a web dispenser and stretching the web along the direction in which it is dispensed;

collapsing the web into a roped configuration;

successively aligning the roped web with and within selected high strength area by moving the web dispenser generally in the longitudinal direction relative to the load and stopping the relative longitudinal movement of the web dispenser and the load at times when the web is in alignment with each of the selected high strength areas;

successively wrapping the roped web circumferentially around the load at each of the selected high strength areas in alignment with and within each of the high strength areas, wherein the roped web applies significant pressure on the load only at the high strength areas;

expanding the web from the roped configuration; and wrapping the expanded web around the load to cover the sides of the load in both the high and low strength areas.

2. The method of claim 1 wherein each of the units is a layer of subunits.

3. The method of claim 1 wherein the high strength areas are proximate to the junctions, and the step of collapsing the web includes forming the web into a configuration having roped edges of concentrated web material and a central unroped portion of web material connecting the roped edges, and the step of wrapping the roped web includes wrapping the roped web around the load at the junctions, covering the junctions with the unroped central portion of the web and grabbing the successive units with the roped edges to hold the units together.

4. The method of claim 1 wherein the web dispenser is moved one way along the longitudinal direction during the step of successively aligning the roped web, and the web dispenser is moved the opposite way along the longitudinal direction during the step of wrapping the expanded web around the load.

5. The method of claim 1 wherein the high strength areas include trays having sidewalls.

6. The method of claim 1 wherein the load has longitudinally extending corners and the step of aligning the roped web includes moving the roped web so that the roped web is wrapped around the corners only at the high strength areas.

7. The method of claim 1 wherein the step of wrapping the roped web occurs before the step of wrapping the expanded web.

8. An apparatus for unitizing a load of successive units stacked in a longitudinal direction, the load having sides with circumferential junctions extending in a lateral direction between successive units, each of the units having at least one high strength area which is resistant to circumferential crushing in the lateral direction and at least one low strength area which is substantially less resistant to circumferential crushing in the lateral direction than the high strength area, comprising:

means for dispensing a web from a web dispenser and stretching the web along the direction in which it is dispensed;

means for collapsing the web into a roped configuration and expanding the web from the roped configuration;

means for controlling the alignment of the roped web by successively aligning the roped web with and within the selected high strength areas by moving the web dispenser generally in the longitudinal direction relative to the load and stopping the relative longitudinal movement of the web dispenser and the load at times when the web is in alignment with each of the selected high strength areas; and means for successively wrapping the roped web circumferentially around the load at each of the selected high strength areas in alignment with and within each of the selected high strength areas wherein the roped web applies significant pressure on the load only at the high strength areas, and for wrapping the expanded web around the load to cover the sides of the load in both the high and low strength areas.

9. The method of claim 1, wherein the load is unitized with a continuous web of packaging material so that the step of successively wrapping the roped web circumferentially around the load at each the selected high strength areas is performed by successively wrapping a continuous roped web of packaging material circumferentially around the load at each of the selected high strength areas.

10. The apparatus of claim 8 wherein each of the units is a layer of subunits.

11. The apparatus of claim 8 wherein the high strength areas are proximate to the junctions, and the means for collapsing the web forms the web into a configuration having roped edges of concentrated web material and a central unroped portion of web material connecting the roped edges, and the means for successively wrapping the roped web wraps the roped web around the load at the junctions, covering the junctions with the unroped central portion of the web and grabbing the successive units with the roped edges to hold the units together.

12. The apparatus of claim 8 wherein the means for aligning moves the web dispenser one way along the longitudinal direction when aligning the roped web, and moves the web dispenser the opposite way along the longitudinal direction when wrapping the expanded web.

13. The apparatus of claim 8 wherein the high strength areas include trays having sidewalls.

14. The apparatus of claim 8 wherein the load has longitudinally extending corners and the means for aligning the roped web aligns the roped web so that the roped web is wrapped around the corners only at the high strength areas.

15. The apparatus of claim 8 wherein the load is unitized with a continuous web of packaging material so that the means for successively wrapping the roped web include means for successively wrapping a continuous web of roped packaging material circumferentially around the load at each of the selected high strength areas.

16. A method of unitizing a load of successive units stacked in a longitudinal direction with a continuous web of packaging material, the load having sides with circumferential junctions extending in a lateral direction between successive units, each of the units having at least one relatively high strength area which is resistant to circumferential crushing in the lateral direction and at least one low strength area which is substantially less resistant to circumferential crushing in the lateral direction than the high strength area, comprising:

dispensing a web from a web dispenser and stretching the web along the direction in which it is dispensed;

collapsing the web into a roped configuration;

successively aligning the roped web with and within selected high strength areas by moving the web dispenser generally in the longitudinal direction relative to the load and stopping the relative longitudinal movement of the web dispenser and the load at times when the web is in alignment with each of the selected high strength areas;

successively wrapping the continuous roped web circumferentially around the load at each of the selected high strength areas in alignment with and within each of the high strength areas, wherein the roped web applied significant pressure on the load only at the high strength areas;

expanding the web for the roped configuration; and wrapping the expanded web around the load to cover the sides of the load in both the high and two strength areas.

17. An apparatus for unitizing a load of successive units stacked in a longitudinal direction with a continuous web of packaging material, the load having sides with circumferential junctions extending in a lateral direction between successive units, each of the units having at least one high strength area which is resistant to circumferential crushing in the lateral direction and at least one low strength area which is substantially less resistant to circumferential crushing in the lateral direction than the high strength area, comprising:

means for dispensing a web from a web dispenser and stretching the web along the direction in which it is dispensed;

means for collapsing the web into a roped configuration and expanding the web from the roped configuration;

means for controlling the alignment of the roped web by successively aligning the roped web with and within the selected high strength areas by moving the web dispenser generally in the longitudinal direction relative to the load and stopping the relative longitudinal movement of the web dispenser and the load at times when the web is in alignment with each of the selected high strength areas; and means for successively wrapping the continuous roped web circumferentially around the load at each of the selected high strength areas in alignment with and within each of the selected high strength areas wherein the roped web applies significant pressure on the load only at the high strength areas, and for wrapping the expanded web around the load to cover the sides of the load in both the high and low strength areas.

* * * * *

UNITED STATES PATENT AND TRADEMARK OFFICE

CERTIFICATE OF CORRECTION

PATENT NO. : 5,195,297

DATED : March 23, 1993

INVENTOR(S) : Lancaster et al.

It is certified that error appears in the above-identified patent and that said Letters Patent is hereby corrected as shown below:

ABSTRACT, title page, line 14, change "lingitudinal" to --longitudinal--.

Claim 9, column 10, line 62, after "each" insert --of--.

Claim 16, column 12, line 9, change "applied" to --applies--; and column 12, line 13, change "two" to --low--.

Signed and Sealed this

Seventh Day of December, 1993

Bruce Lehman

*Attest:*

BRUCE LEHMAN

*Attesting Officer*

*Commissioner of Patents and Trademarks*